United States Patent [19]

Watkins et al.

[11] 4,342,989

[45] Aug. 3, 1982

[54] DUAL CRT CONTROL UNIT SYNCHRONIZATION SYSTEM

[75] Inventors: Richard R. Watkins, Chelmsford, Mass.; Richard A. Slater, Nashua, N.H.

[73] Assignee: Honeywell Information Systems Inc., Waltham, Mass.

[21] Appl. No.: 34,833

[22] Filed: Apr. 30, 1979

[51] Int. Cl.[3] ..... G09G 1/16

[52] U.S. Cl. ..... 340/723; 340/814

[58] Field of Search ..... 340/723, 790, 814, 803, 340/789; 364/200 MS File, 900 MS File

[56] References Cited

U.S. PATENT DOCUMENTS 3,757,306 9/1973 Boone ..... 364/200

3,916,402 10/1975 Hornung ..... 340/814

3,930,250 12/1975 Blejwas, Jr. et al. ..... 340/814

3,961,133 6/1976 Bennett ..... 340/723

4,156,254 5/1979 Marino ..... 340/814

OTHER PUBLICATIONS

RCA Product Guide; CDL-820D; p. 34; 8/71.

*Primary Examiner*—Marshall M. Curtis

*Attorney, Agent, or Firm*—Nicholas Prasinos; Gerald E. Lester

[57] ABSTRACT

A logic control system in a video display terminal is disclosed for synchronizing the operation of dual, asynchronously operating CRT control unit semiconductor chips to accommodate a substantially increased number of visual attributes per display row with minimal effect on data character transfer rates.

3 Claims, 2 Drawing Figures

DUAL CRT CONTROL UNIT SYNCHRONIZATION SYSTEM

BACKGROUND OF THE INVENTION

1. Field of the Invention

The invention relates to video terminal display control systems, and more particularly to a logic control circuit wherein dual CRT control unit chips may be used in combination to provide a substantially increased number of visual attributes per display row with minimal effect on data transfer rates.

2. Prior Art

Programmable CRT control unit semiconductor chips have been used in video display terminals to autonomously issue data request signals in regular time intervals. In response thereto, video display character and visual display attribute bytes are stored into the CRT controller unit, and thereafter provided to a CRT control system for display on a CRT screen at a system clock rate. The CRT control unit chips generally have supported 25 line CRT displays.

With the increased reliance upon video display terminal systems in the day-to-day operation of commercial enterprises, an increased demand for greater flexibility in the number of display attributes that may be applied to a display character has occurred. Such display attributes include a character underline, character blinking, character blank, inverse video contrast, alternate character selection, and lowered character intensity.

The ability to increase the number of visual attributes that may be provided in a display row of information characters has been limited by the storage capacity of the CRT control unit chips. A need has arisen for an application of available CRT control unit chips wherein additional visual attributes may be provided in a display row with minimal effect on data character transfer rates, and without substantially increasing the complexity of the video display control circuitry.

SUMMARY OF THE INVENTION

The invention is directed to a logic control system for synchronizing the operation of dual, near autonomously operating CRT control unit semiconductor chips to provide enlarged fields of visual attributes for each row of video information to be displayed on a CRT screen.

More particularly, video data characters may be loaded into one of two CRT control units, and visual attributes may be loaded in a second CRT control unit. Video synchronization signals issued by each CRT control unit in the transfer of video information to a CRT control system are sensed by leading edge detection logic. Each of the synchronization signals occur at a system clock rate. If the video synchronization signals are not in phase, the first occurring of the two signals is sensed during the leading half of a system clock time period. An enable control pulse thereafter is provided which occurs one-half of a system clock period after the first occurring synchronization signal transitions to a logic one level. The enable control pulse is applied to disable the system clock input to the first CRT control unit during the second half of the system clock time period. The logic level of the first occurring synchronization signal thereby is frozen until the second occurring synchronization signal enters into phase with the first occurring synchronization signal. Each of the CRT control units thereafter again are enabled for free running operation to provide both video character data and visual attribute bytes within a same system clock time period.

DESCRIPTION OF THE DRAWINGS

For a more complete understanding of the present invention, and for further objects and advantages thereof, reference may now be had to the following description taken in conjunction with the accompanying drawings in which.

DESCRIPTION OF THE PREFERRED EMBODIMENT

FIG. 1

Figure 1:
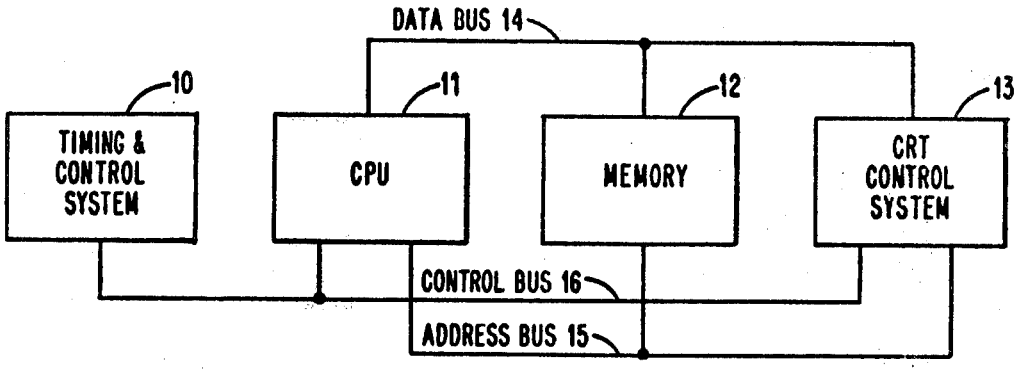
FIG. 1 is a functional block diagram of a video display system embodying the invention.

FIG. 1 illustrates in functional block diagram form a video terminal system comprising a timing and control system 10, a central processing unit (CPU) 11, a memory unit 12 and a cathode ray tube (CRT) control system 13. Communication between the devices comprising the video terminal system is accomplished by way of a bidirectional data bus 14, an address bus 15 and a control bus 16.

The invention disclosed herein is embodied in the CRT control system 13.

The timing and control system 10 generates the cycle timing for the data bus 14, address bus 15 and the control bus 16. The system bus timing is divided into an address phase and a data phase which are offset. The system bus timing further is divided into alternate CPU cycles and direct memory access (DMA) cycles. The DMA cycles are used by peripheral subsystems to communicate with memory unit 12. The CPU 11 is operative during CPU cycles, while the CRT control system 13 is operative during DMA cycles.

The memory unit 12 is comprised of a random access memory (RAM) and a read only memory (ROM). Microprogrammed subroutines are stored in the ROM to control overall systems operation. Sections of the RAM, however, are set aside as registers, buffers and word areas to be used during system operation. The memory unit 12 is operative during both CPU and DAM bus cycles. When a memory address is received by the memory unit 12 from the CPU 11 by way of address bus 15 during a memory read cycle, a data word is provided by the memory unit 12 to the data bus 14. During a memory write cycle, a data word is received from the CPU 11 by way of data bus 14, and is written into the memory location addressed by the CPU 11 on the address bus 15.

The CPU 11 thus is operative with both the data bus 14 and the address bus 15 during CPU cycles. During system operation, the CPU 11 may read or write into the RAM of the memory unit 12 to accommodate necessary system bookkeeping. The CPU 11 further controls the overall system operation through access to a microprogrammed subroutine stored in the ROM of the memory unit 12.

The CRT control system 13 is operative during DMA cycles, during which the control system supplies memory address signals to the memory unit 12 by way of the address bus 15. Control information and data characters thereby are addressed for each row of information supplied by the memory unit 12 to the control system 13 by way of data bus 14.

A brief description of control signals generated and received by the timing and control system 10 by way of control bus 16 during system operation are described below:

CPUADR−00

CPU Address Control

This signal defines the DMA and the CPU bus cycle timing of address bus 15. When the signal is low, the CPU address lines are gated to the address bus 15. When the signal is high, the DMA address lines are gated to the address bus 15.

CPUDAT−00

CPU Data Control

This signal defines the DMA and the CPU bus cycle timings. When the signal is low, the CPU controls the direction and purpose of the data bus 14. When the signal is high, the DMA devices control the data bus 14.

BUSRWC+00

Bus Read Write Control

This signal defines the type of data transfer on the data bus 14. It is valid during the CPUADR time for that phase of the bus cycle.

When the signal is at a logic one level during a CPU cycle, data is read from a device such as memory unit 12 to the CPU 11 over the data bus 14. When the signal is at a logic zero level, the data is written from the CPU 11 to the memory unit 12 over the data bus 14. If the signal is at a logic one level during a DMA cycle, data is read from the memory unit 12 to the CRT control system 13 over the data bus 14. If the signal is at a logic zero level, data is sent to the memory unit 12 over the data bus 15 from the control system 13.

MEMSTR−00

Memory Strobe

This signal provides internal timing pulses for the memory unit 12 during CPU and DMA bus cycles.

DEVSTR−00

Device Start

This signal is used by the CRT control system 13 as a clock pulse.

BUS010−00

Bus Strobe 1

This signal is used by the CRT control system 13 as a clock pulse.

BUS030+

Bus Strobe 3

When the signal is at a logic one level during CPU and DMA bus cycles, the memory unit 12 output is enabled during a read operation.

The signal further provides timing pulses to the CRT control system 13.

BUS030−

Bus Strobe 3

When the signal is at a logic zero level during DMA bus cycles, the CRT control system 13 is activated.

DMAREQ

DMA Request

The DMAREQ+01 DMA request signal is assigned to the CRT control system 13. In the preferred embodiment described herein, there are four DMA bus cycle time slots: DMA1, DMA2, DMA3 and DMA4. A subsystem requests an assigned DMA bus cycle by forcing its DMAREQ signal to a logic zero level.

DMAKXO−

DMA Acknowledge

The four DMA acknowledge signals DMAK10−, DMAK20−, DMAK30− and DMAK40− define respective time slots on the control bus 16 when forced to a logic zero level.

BRESET−00

Bus Reset

This signal is used by the CPU 11 to clear registers and reset flip-flops throughout the video terminal display system. System reset occurs when the signal transitions to a logic zero level.

BUSREF+00

Bus Refresh Line

When this signal is at a logic one level, a memory refresh cycle occurs. In the preferred embodiment disclosed herein, the signal is active for DMA1 cycles every 16 microseconds.

FIG. 2

Figure 2:
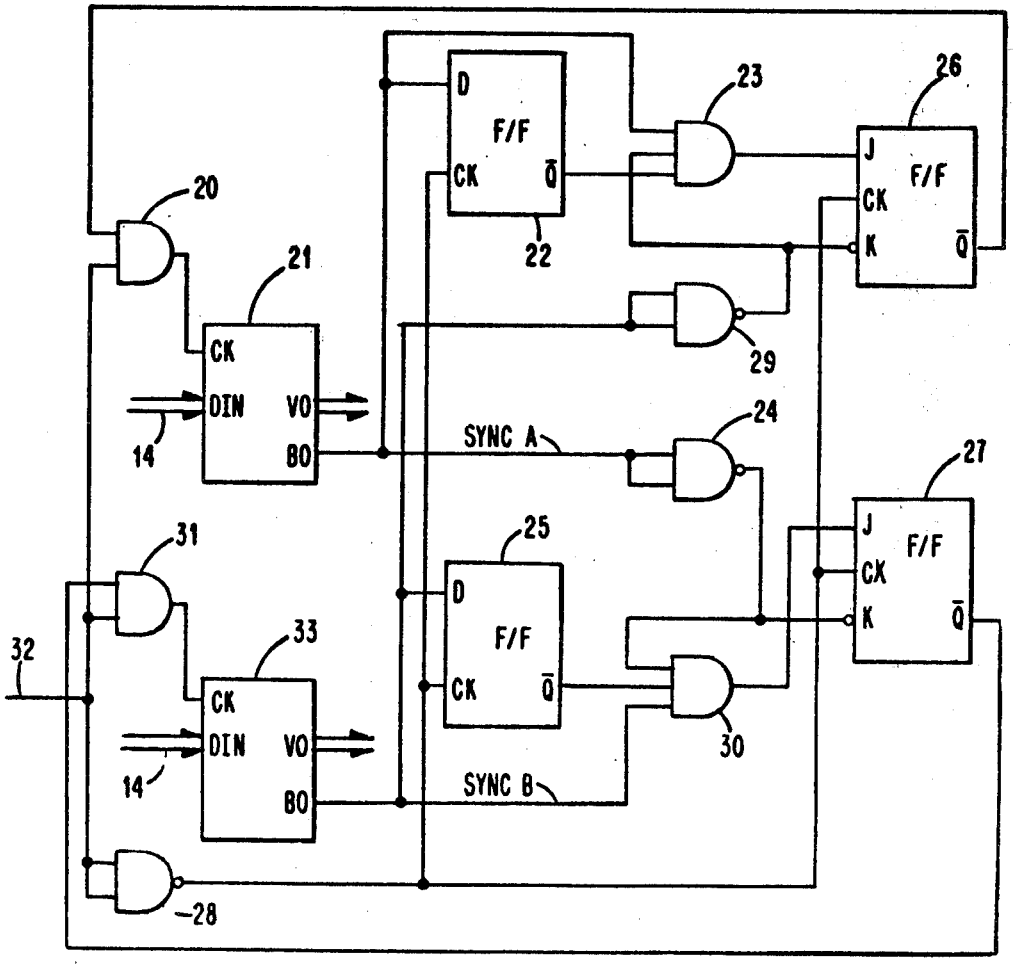
FIG. 2 is a detailed logic diagram of the invention.

FIG. 2 illustrates in detailed logic diagram form the invention embodied in the CRT control system 13 of FIG. 1.

In referring to the logic diagram illustrated in FIG. 2, it is to be understood that the occurrence of a small circle at the input of a logic device indicates that the input is enabled by a logic zero. Further, a circle appearing at an output of a logic device indicates that when the logic conditions for that particular device are satisfied, the output will be a logic zero.

Referring to FIG. 2, the output of an AND gate 20 is applied to the clock input of a CRT control unit 21, the data input (DIN) of which is connected to data bus 14 of FIG. 1. The B0 output of the control unit 21 is applied to the D input of a D-type flip-flop 22, to one input of an AND gate 23, and to two inputs of a NAND gate 24. The Q output of flip-flop 22 is connected to a second input of gate 23. The clock input to the flip-flop 22 is connected to the clock input of a D-type flip-flop 25, to the clock input of a J-K flip-flop 26, to the clock input of a J-K flip-flop 27, and to the output of a NAND gate 28.

The J input to the flip-flop 26 is connected to the output of gate 23, and the K input to the flip-flop is connected to a third input of gate 23 and to the output of a NAND gate 29. The Q output of flip-flop 26 is connected to an input of gate 20.

The J input to flip-flop 27 is connected to the output of an AND gate 30, one input of which is connected to the Q output of flip-flop 25. The K input to flip-flop 27 is connected to the output of gate 24 and to a second input to gate 30. The Q output of flip-flop 27 is connected to one input of an AND gate 31.

A second input to gate 31 is connected to a second input of gate 20, to two inputs of gate 28, and to a control line 32 leading from a 19.712 MHz clock source. The output of gate 31 is connected to the clock input of a CRT control unit 33, the DIN input of which is connected to data bus 14 of FIG. 1. The B0 output of the CRT control unit 33 is connected to two inputs of gate 29, to the D input of flip-flop 25, and to a third input of gate 30.

The CRT control units 21 and 33 are each of the type manufactured and sold to the public by the Intel Corporation of Santa Clara, Calif. as Programmable CRT Controller 8275. The control units are described further in the Intel Corporation's 1978 Component Data Catalog.

In operation, the logic control system of FIG. 2 receives a clock signal on control line 32. The clock signal is applied through gates 20 and 31 to the clock inputs of the CRT control units 21 and 33. In response thereto, the CRT control units provide synchronization control signals at their B0 outputs which are asynchronous to each other. The control signals are supplied to a CRT control system to synchronize the transfer of video data from the V0 outputs of the control units.

If the synchronization control signal at the B0 output of control unit 21, SYNC A, transitions to a logic one level prior to the synchronization control signal at the B0 output of control unit 33, SYNC B, an enable control signal is generated to control the clock input to the control unit 21 as shall be further described. More particularly, the SYNC A signal is applied to the D input of flip-flop 22, and enables gate 23. At this time, the Q output of flip-flop 22 is at a logic one level. The SYNC B signal is inverted by gate 29 to apply a third logic one signal to gate 23, and a logic one signal to the K input of flip-flop 26. Upon the occurrence of a leading edge of a logic one pulse in the system clock signal at the output of gate 28, the Q outputs of flip-flops 22 and 26 transition to a logic zero. The gate 20 thereby is disabled to deactivate the CRT control unit 21, and freeze the SYNC A signal in the logic one state.

The system clock signal on control line 32 is inverted by gate 28. The B0 outputs of control units 21 and 33 thus are sensed during the leading half of a system clock time period, and the gates 20 or 31 are disabled or enabled during a second half of the system clock time period.

When both the SYNC A and SYNC B signals are at a logic one level during a first half of a system clock time period, the logic one level is applied to the D input to flip-flop 22 and to the gate 23. The output of gate 29, however, shall transition to a logic zero level to disable gate 23. Upon the next occurrence of a rising edge in the clock signal of gate 28, the Q output of flip-flop 25 transitions to a logic zero level and the Q output of flip-flop 26 transitions to a logic one level to enable gate 20. The CRT control unit 21 thereupon is reactivated.

If the SYNC B signal were to transition to a logic one level before the SYNC A signal, the SYNC B signal is sensed during a first half of a system clock time period by flip-flop 25 and gate 30. Since the SYNC A signal at this time is at a logic zero level, the outputs of gates 24 and 30 transition to a logic one level. Upon the next occurrence of a rising edge at the output of gate 28, the Q outputs of flip-flops 25 and 27 transition to a logic zero level during the second half of the system clock time period. The gate 31 thereby is disabled to freeze the SYNC B signal in the logic one state.

When both the SYNC A and SYNC B signals are in a logic one state, the gates 20 and 31 are enabled as before described.

Having described the invention in connection with certain specific embodiments thereof, it is to be understood that further modifications may now suggest themselves to those skilled in the art, and it is intended to cover such modifications as fall within the scope of the appended claims.

What is claimed is:

1. A logic control system for providing a binary information stream of characters to a video display system, wherein said information stream may include both a data character byte and a visual attribute byte within same time periods of a system clock signal, which comprises:

(a) a pair of CRT control units having data character and visual attribute bytes stored therein, and responsive to said system clock signal and operable at said system clock signal rate for supplying said information stream to said video display system;

(b) first edge detector means for sensing during a leading half of a time period of said system clock signal a first synchronization signal supplied by a first of said pair of control units;

(c) a second edge detector means for sensing during said leading half of said time period a second synchronization signal supplied by a second of said pair of control units;

(d) first logic enable means responsive to said first edge detector means during a trailing half of said time period for disabling said first of said pair of control units if said first synchronization signal leads said second synchronization signal in phase, and enabling said first of said pair of control units if said first and said second synchronization signals are in phase; and (e) second logic enable means responsive to said second edge detector means during a trailing half of said time period for disabling said second of said pair of control units if said second synchronization signal leads said first synchronization signal in phase, and enabling said second of said pair of control units if said first and said second synchronization signals are in phase.

2. A logic control system for providing a binary information stream of characters to a video display system, wherein said information stream may include both a data character and a visual attribute character within same time periods of a system clock signal, which comprises:

(a) a first pair of AND gates responsive to said system clock signal;

(b) a NAND gate responsive to said system clock signal;

(c) a first CRT control unit means having data character bytes stored therein, and receiving a clock signal from a first of said first pair for providing a first synchronization signal at a clock rate of said system clock signal;

(d) second CRT control unit means having visual attribute character bytes stored therein, and receiving a clock signal from a second of said first pair for providing a second synchronization signal at said clock rate but asynchronous to said first synchronization signal;

(e) logic inversion means responsive to said system clock signal;

(f) a first D-type flip-flop receiving said first synchronization signal and responsive to said logic inversion means;

(g) a second D-type flip-flop receiving said second synchronization signal and responsive to said logic inversion means;

(h) first and second NAND gates respectively responsive to said second and said first synchronization signals;

(i) a second pair of AND gates with a first of said second pair responsive to the negation output of said first D-type flip-flop, said first synchronization signal and said first NAND gate, and a second of said second pair responsive to the negation output of said second D-type flip-flop, said second synchronization signal and said second NAND gate;

(j) a first J-K flip-flop receiving a J input from said first of said second pair, a K-input from said first NAND gate and responsive to said logic inversion means for providing an enable control signal to said first of said first pair; and (k) a second J-K flip-flop receiving a J-input signal from a second of said second pair, a K-input signal from said second NAND gate and responsive to said logic inversion means for providing an enable control signal to said second of said first pair.

3. A method of inserting a video data character byte and a visual attribute byte in a same time period of a system clock signal to provide a binary video information stream to a CRT screen with minimal effect on data transfer rates, which comprises:

(a) sensing during a leading half of a time period of said system clock signal a first synchronization signal issued at a system clock rate from a first CRT control unit having video data character bytes stored therein;

(b) sensing during said leading half of said time period of second synchronization signal issued at said system clock rate from a second CRT control unit having visual attribute bytes stored therein;

(c) enabling during a trailing half of said time period said first and said second CRT control units in the event said first and said second synchronization signals are in phase, thereby releasing said first and said second CRT controls units for free running operation during a next occurring time period of said system clock signal;

(d) disabling during said trailing half of said time period one of said first and said second CRT control units in the event said first and said second synchronization control signals are not in phase, thereby freezing the first occurring of said first and said second synchronization signals during a leading half of a next occurring time period of said system clock signal; and (e) repeating steps (a)–(d) to provide an enlarged field of visual attributes for each row of video information to be displayed on said CRT screen.

* * * * *